US006742720B2

(12) United States Patent
Nolen

(10) Patent No.: US 6,742,720 B2
(45) Date of Patent: Jun. 1, 2004

(54) SPRAY APPLICATION SYSTEM

(75) Inventor: Gary Nolen, Fayetteville, AR (US)

(73) Assignee: Safe Foods Corp., North Little Rock, AR (US)

( * ) Notice: Subject to any disclaimer, the term of this patent is extended or adjusted under 35 U.S.C. 154(b) by 157 days.

(21) Appl. No.: 10/001,896

(22) Filed: Nov. 19, 2001

(65) Prior Publication Data

US 2002/0088874 A1 Jul. 11, 2002

Related U.S. Application Data

(60) Provisional application No. 60/249,803, filed on Nov. 17, 2000.

(51) Int. Cl.[7] ..... B05B 3/00

(52) U.S. Cl. ..... 239/206; 239/207; 134/104.4

(58) Field of Search ..... 239/206, 207, 239/209; 134/104.4, 105, 108, 109, 110, 114, 155

(56) References Cited

U.S. PATENT DOCUMENTS

| | | | | | |
|---|---|---|---|---|---|
| 2,856,631 | A | | 10/1958 | Day | |
| 3,038,481 | A | | 6/1962 | Brechtel | |
| 3,571,845 | A | * | 3/1971 | Martin et al. | 452/63 |
| 3,749,319 | A | * | 7/1973 | Fischer | 239/318 |
| 3,787,230 | A | | 1/1974 | Hoffman et al. | |
| 3,837,045 | A | * | 9/1974 | Blacker | 452/117 |
| 4,074,389 | A | * | 2/1978 | Blair et al. | 99/533 |
| 4,378,235 | A | | 3/1983 | Cosper et al. | |
| 4,399,742 | A | | 8/1983 | Dobias | |
| 4,948,513 | A | | 8/1990 | Mitchell | |
| 4,971,084 | A | | 11/1990 | Smith et al. | |
| 5,232,299 | A | * | 8/1993 | Hiss | 401/143 |
| 5,250,189 | A | | 10/1993 | Rey | |
| 5,322,078 | A | * | 6/1994 | Tuttle | 134/104.4 |
| 5,334,255 | A | | 8/1994 | James et al. | |
| 5,499,643 | A | * | 3/1996 | Vincent et al. | 134/104.4 |
| 5,622,196 | A | | 4/1997 | Luongo | |
| 5,640,981 | A | * | 6/1997 | Niemela et al. | 134/114 |
| 5,669,401 | A | * | 9/1997 | Mansur | 134/108 |
| 5,954,070 | A | * | 9/1999 | Abad et al. | 134/89 |
| 6,003,530 | A | * | 12/1999 | Giuseppe | 134/102.1 |
| 6,279,838 | B1 | * | 8/2001 | Sivells et al. | 239/146 |
| 6,289,905 | B1 | * | 9/2001 | Yarnold | 134/111 |
| 6,451,125 | B1 | * | 9/2002 | McClure et al. | 134/10 |
| 6,568,409 | B1 | * | 5/2003 | Fleck | 134/110 |

* cited by examiner

*Primary Examiner*—Gene Mancene
*Assistant Examiner*—Thach H Bui
(74) *Attorney, Agent, or Firm*—Mark Rogers; Gary N. Speed

(57) ABSTRACT

A spray application system is disclosed having an enclosure with a spray chamber, a spray applicator within the chamber, and a liquid barrier such as a sprayed water curtain, within the chamber, upstream or downstream of the spray applicator. The water is preferably sprayed downward to create a vacuum for drawing the treating substance downward into the liquid barrier. The liquid barrier preferably does not contact the workpieces that instead pass overhead. Independent pressure gauges and flow regulators may be used for the upstream liquid barrier, the downstream liquid barrier, and the spray applicator. The chamber may have a roof section that is secured to a beam or other process line support, and the walls may be suspended from the roof section. The roof section may have an opening running across its length to allow hangers from an overhead processing line to pass through the chamber.

23 Claims, 6 Drawing Sheets

SPRAY APPLICATION SYSTEM

This application claims the benefit of U.S. Provisional Application Ser. No. 60/249.803, filed on Nov. 17, 2000, the disclosure of which is incorporated herein by reference.

BACKGROUND OF THE INVENTION

This invention relates to a spray application system, and more particularly to a spray application system with spray containment features.

Spray application systems and spray cabinets are known in the art. A spray cabinet may be used for example as part of a meat, poultry, or other food processing line to treat food, food packaging, or some other workpiece by spraying a desired substance onto the food, food packaging, or other workpiece. Spray cabinets provide a useful way of providing for modular treatment of items in a processing line, but spray cabinets suffer from a number of shortcomings. For example, installing a spray cabinet in a processing line typically requires intrusive procedures that are time consuming and that may compromise the overall integrity of the line.

Spray cabinets also typically do not provide for adequate access to the interior of the cabinets for maintenance, repairs, or adjustments, and typically do not provide for adequate flexibility in adjusting the operation of the cabinets.

Spray cabinets are also occasionally equipped with exhaust fans if there is a need for containment or control of the substance being sprayed. Such exhaust fans are useful and have been used with some degree of success in the past. Still, exhaust fans have a number of shortcomings. For example, the cost and complexity of fitting a spray cabinet with an exhaust fan and difficulties in dealing with fumes vented by the fans make such exhaust fans undesirable in many instances. Also, mechanical problems and wear and tear can become an issue when adding equipment with such rapidly moving parts. Further, the vacuum created by such exhaust fans may not provide for adequate containment or may adversely effect the treating of the food or other workpiece being treated.

SUMMARY OF THE INVENTION

It is therefore an object of the present invention to provide a spray application system that uses a liquid barrier to contain the substance being sprayed or applied within a chamber.

It is therefore an object of the present invention to provide a spray application system that uses a sprayed water curtain to contain the substance being sprayed or applied within a chamber.

It is a further object of the present invention to provide a system of the above type that is easily installed in a processing line without intrusive procedures.

It is a still further object of the present invention to provide a system of the above type that provides easy access to the interior of the spray chamber for maintenance, repair, or adjustment.

It is a still further object of the present invention to provide a system of the above type which man be easily adjusted to provide for greater flexibility.

It is a still further object of the present invention to provide a system of the above type which provides for independent control of upstream and downstream liquid barriers and for the spray applicator.

It is a still further object of the present invention to provide a system of the above type which provides for improved collection of the substances to be contained.

Toward the fulfillment of these and other objects and advantages, the spray application system of the present invention comprises a spray chamber, a spray applicator within the chamber, and at least one liquid barrier within the chamber, disposed upstream or downstream of the spray applicator. The liquid barrier may take the form of a sprayed water curtain. The water forming the liquid barrier is preferably sprayed in a downward direction to create a vacuum for drawing the treating substance downward into the liquid barrier. Each liquid barrier is also preferably disposed so that it does not contact the workpieces as the workpieces pass through the chamber, the workpieces instead passing above each liquid barrier. Independent pressure gauges and flow regulators may be used for the upstream liquid barrier, the downstream liquid barrier, and the spray applicator. The liquid barrier may be created using a header assembly with one or more nozzles, and the nozzles may be disposed on opposite sides of the chamber and directed toward a center portion of a width of the chamber to create the barrier or curtain. The chamber may have a roof section that is secured to a beam or other process line support, and the walls may be secured to and suspended from the roof section. In a preferred, alternate embodiment, the roof section may have an opening running across its length to allow hangers from a processing line disposed above the chamber to pass through the chamber. Access doors may be provided on both sides of the chamber.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figures 1, 2:
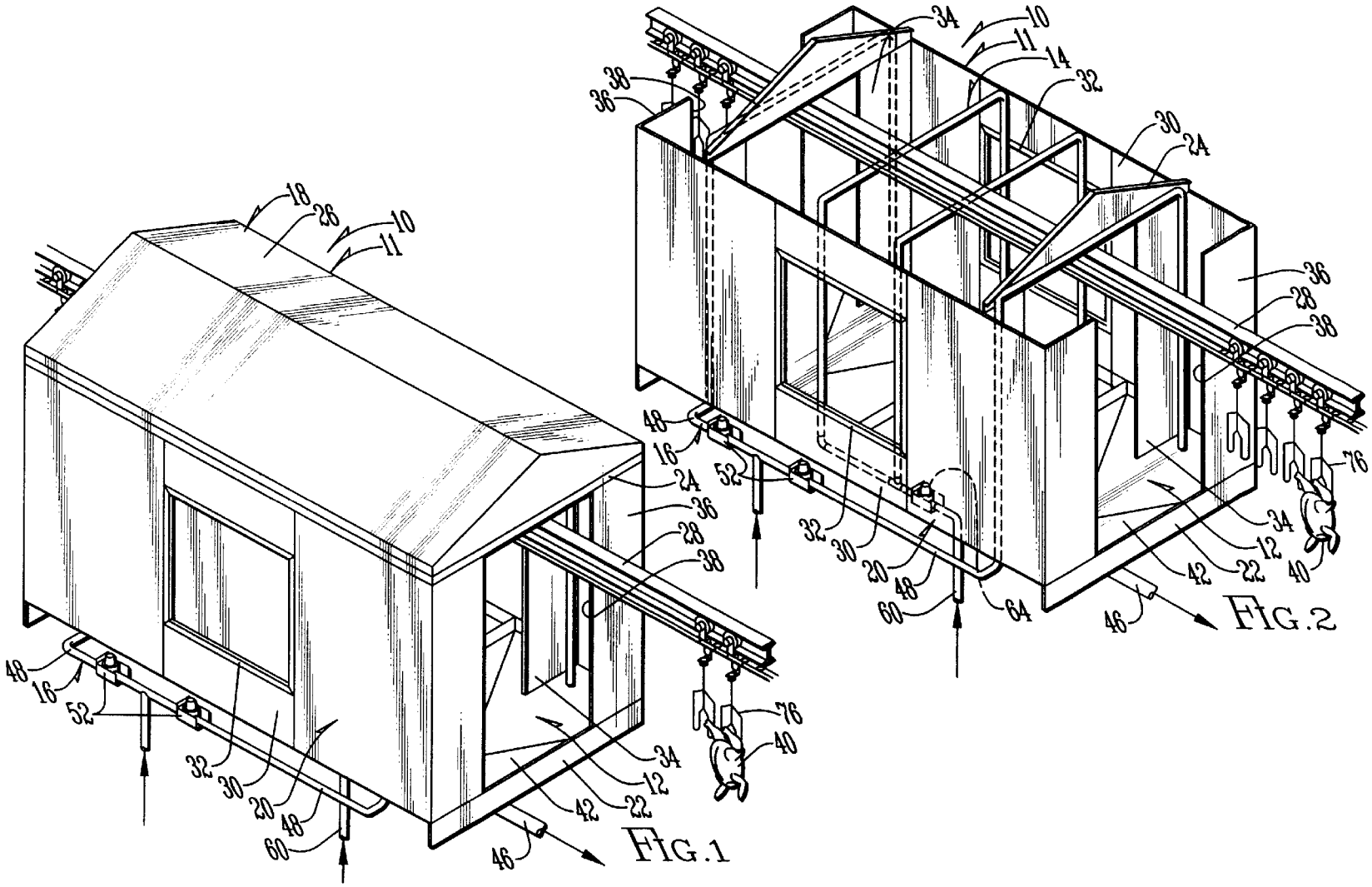
FIG. 1 is an isometric view of a spray application system of the present invention.
FIG. 2 is a partially exploded isometric view of a spray application system of the present invention.
Figure 3:
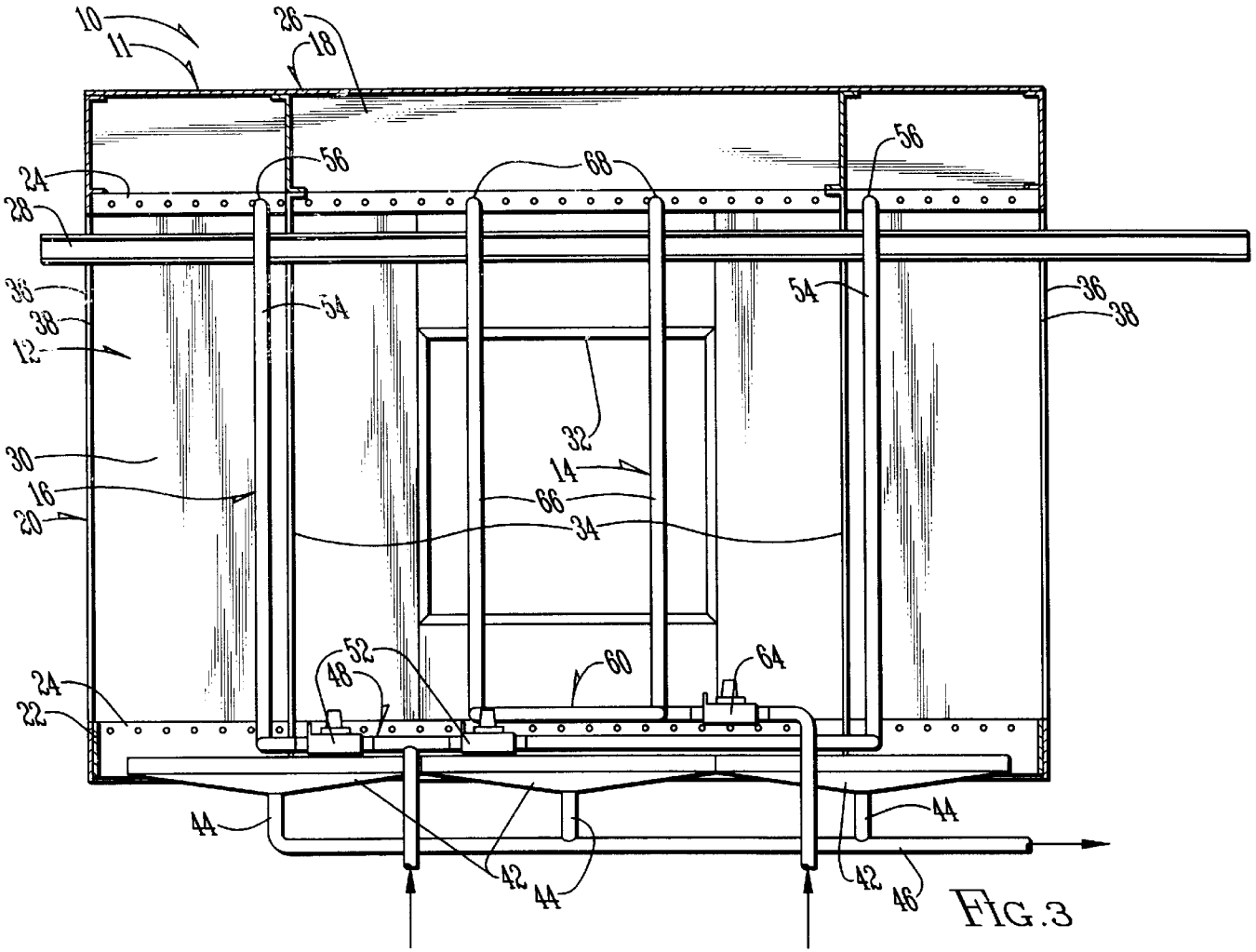
FIG. 3 is a partially exploded side view of a spray application system of the present invention.

Referring to FIG. 1, the reference numeral 10 refers in general to a spray application system of the present invention. As best seen in FIG. 2, the system 10 comprises an enclosure 11 having a chamber 12, a spray applicator assembly 14, and one or more liquid barrier generating assemblies 16.

Referring to FIG. 1, the enclosure 11 comprises a roof section 18, walls 20, and a floor section 22. The roof section has a frame 24 and a cap 26. The cap 26 is preferably pitched so that it will more effectively shed water after cleaning. The cap 26 is affixed to the frame 24, and the frame 24 is affixed, such as by welding, to an I-beam 28 or other support such as the type used in a meat or poultry processing line. Particularly for food processing applications it is preferred that the roof section, walls 20, and floor section 22 be stainless steel. Of course, these components may be made from any number of different materials.

The walls 20 are secured to and suspended from the frame 24. Two side walls 30 extend over the entire length of the chamber 12. Viewing windows or access doors or ports 32 are provided in both side walls 30, preferably aligned with the spray applicator assembly 14. Skirts or baffles 34 are secured to the side walls 30, disposed adjacent to and inward of the upstream and downstream header assemblies 48. End walls 36 are disposed at the upstream and downstream ends of the enclosure 11. Openings 38 are provided in the end walls 36 to allow the meat, poultry, or other workpieces 40 being processed to pass into and from the chamber 12. The floor section 22 is comprised of three drain pans 42. Drain pipes 44 are connected to the bottom of the drain pans 42. The drain pipes 44 may connect to a common manifold 46 for commingling of liquids passing through the three drain pans 42, or the drain pipes 44 may pass their contents separately to recovery or disposal areas. Also, particularly for food processing applications, it is preferred that all junctions and unions between the cap 26, frame 24, walls, doors 32, windows, and floor section 22 provide for NEMA 4 seals.

Figure 4:
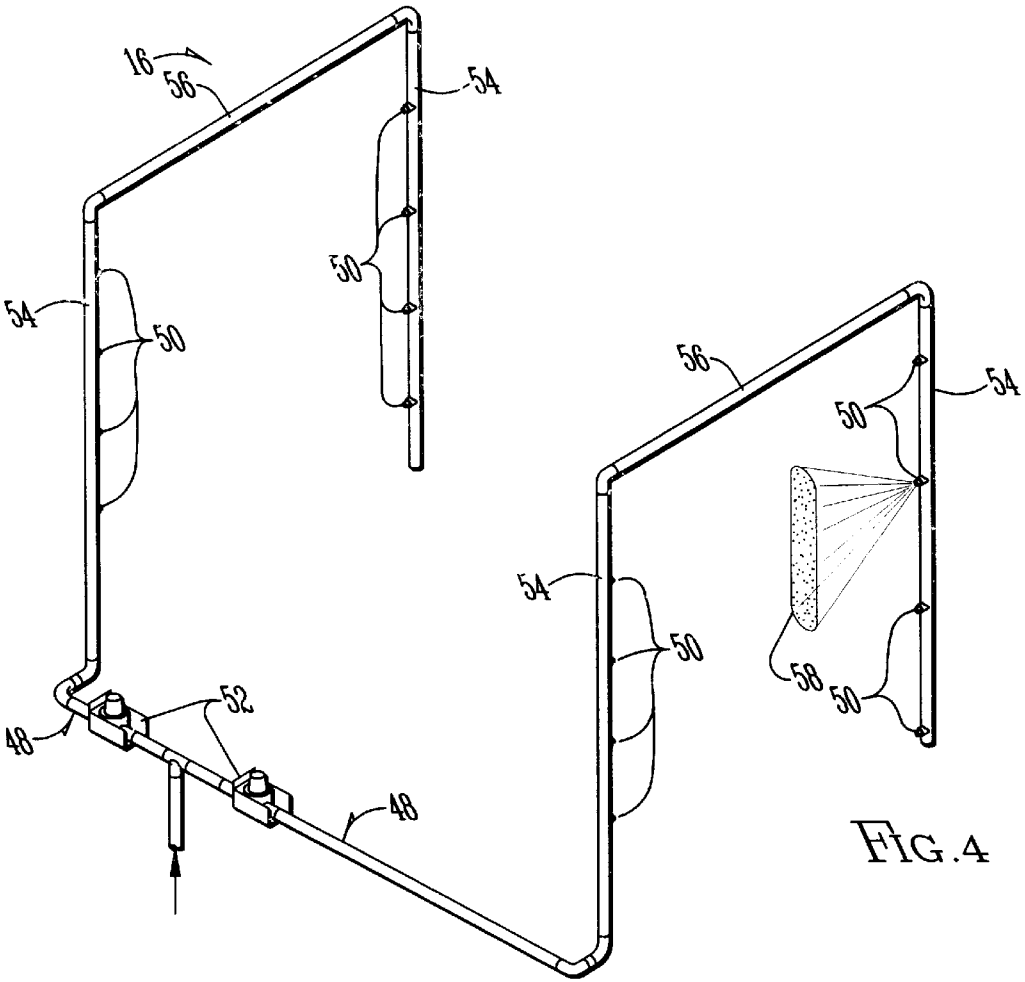
FIG. 4 is an isometric view of a liquid barrier header assembly of a spray application system of the present invention.

Each liquid barrier generating assembly is comprised of at least one header assembly 48 and at least one nozzle 50. The header assembly 48 preferably has a plurality of nozzles 50. Separate flow regulators 52, filters, pressure gauges, and similar accessories may also be provided to each header assembly 48. Each header assembly 48 has two vertical legs or pipes 54 disposed on opposite sides of the chamber 12, and an upper horizontal leg or pipe 56 disposed between and connecting the two vertical legs 54. The junctions between the horizontal leg 56 and vertical legs 54 are preferably threaded junctions or union fittings for ease of assembly and for ease in suspending the enclosure 11 from the beam 28 without the need to cut or weld pipes or beams. The nozzles 50 comprise flat spray nozzles with ball fittings that allow for a range of motion or adjustment over a range of approximately 45°. The nozzles 50 are positioned to spray a liquid 58 in a direction that is approximately perpendicular to the beam 28, to create a sheet-like sprayed liquid barrier that is roughly planar and perpendicular to the beam 28. The liquid barrier is preferably water so that the liquid barrier comprises a sprayed water curtain. One portion of the liquid barrier, created by one nozzle 50 of the liquid barrier generating assembly 16 is shown in FIG. 4. When used in connection with food processing lines, the legs or pipes 54 and 56 and nozzles 50 are preferably stainless steel. It is of course understood that PVC or other pipes or conduits 54 and 56 may be used and that the header assemblies 48 and nozzles 50 may take any number of shapes and sizes.

Figure 6:
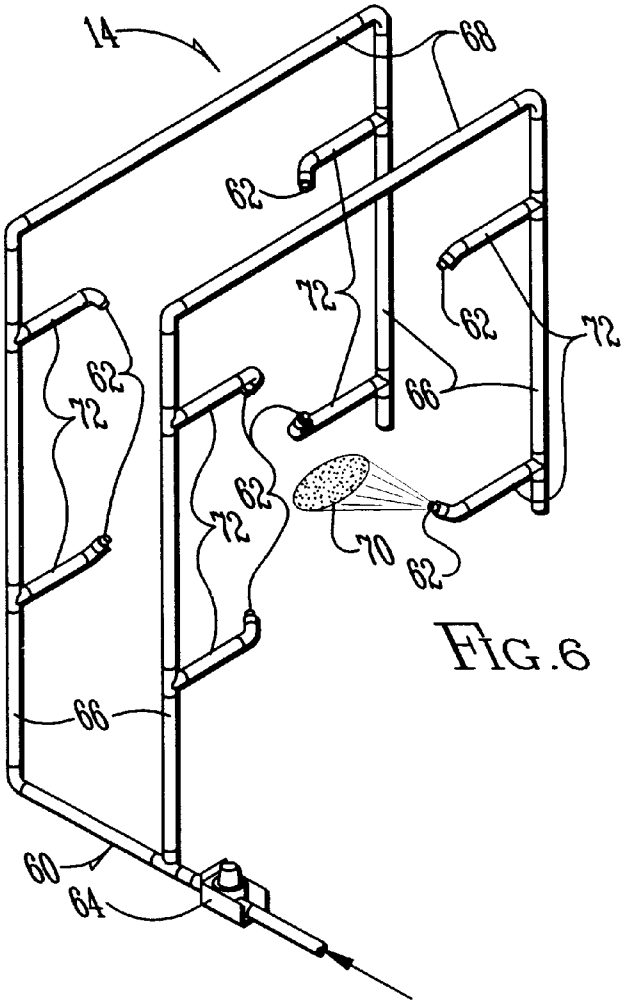
FIG. 6 is an alternate embodiment of an isometric view of a spray applicator assembly of a spray application system of the present invention.
Figure 5:
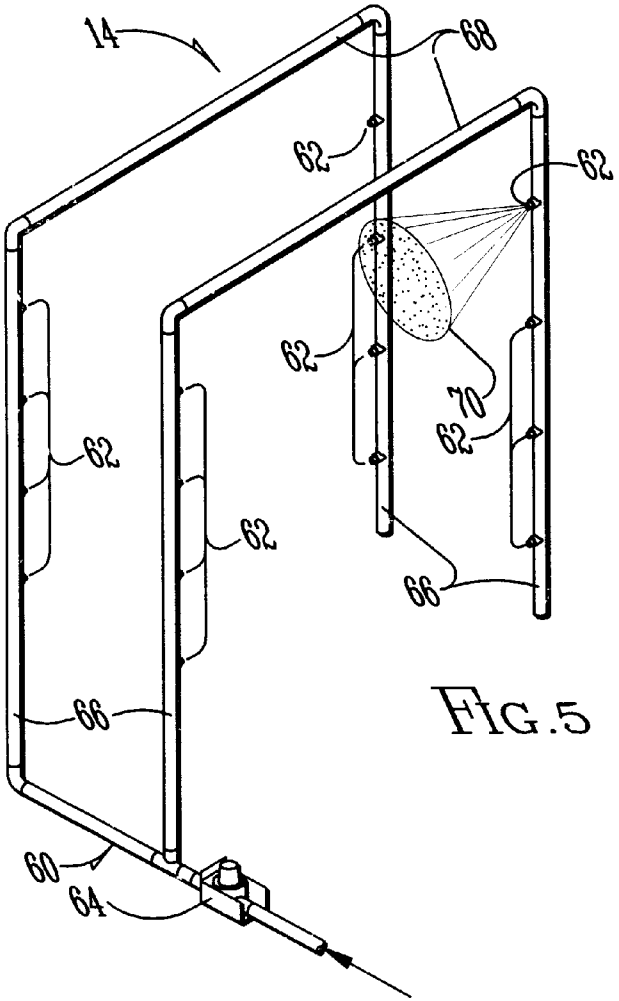
FIG. 5 is an isometric view of a spray applicator assembly of a spray application system of the present invention.

Referring to FIG. 5, each spray applicator assembly 14 is comprised of at least one header assembly 60 and at least one nozzle 62. Each header assembly 60 preferably has a plurality of nozzles 62. Separate flow regulators 64, filters, pressure gauges, and similar accessories may also be provided to each header assembly 60. Each header assembly 60 has one or more sets of generally C-shaped portions having two vertical legs or pipes 66 disposed on opposite sides of the chamber 12, and an upper horizontal leg or pipe 68 disposed between and connecting the two vertical legs 66. The junctions between the horizontal leg 68 and vertical legs 66 are preferably threaded junctions or union fittings for ease of assembly and for ease in suspending the enclosure 11 from the beam 28 without the need to cut or weld pipes or beams. The nozzles 62 comprise high pressure atomizers that produce a fine dispersing spray and are preferably full cone pressure nozzles 62. One portion of the spray application or treatment zone of the treating substance 70 created by one nozzle 62 of the spray applicator assembly 14 is shown in FIG. 5. In the alternate embodiment shown in FIG. 6, extension pipes 72 are used to position the nozzles 62 closer to the meat, poultry, or workpiece 40. The upper nozzles 62 are angled inward and downward, and the lower nozzles 62 are angled inward and upward. One portion of the spray application of the treating substance 70 created by one nozzle 62 of the spray applicator assembly 14 is shown in FIG. 6. When used in connection with food processing lines, the legs or pipes 66 and 68 and nozzles 62 are preferably stainless steel. It is of course understood that PVC or other pipes or conduits 66 and 68 man be used and that the header assemblies 60 and nozzles 62 may take any number of shapes and sizes.

In operation of the embodiment depicted in FIGS. 1–6, flow control valves 52 are opened to allow a liquid 58, preferably water, to flow through the header assemblies 48, to and through nozzles 50 to create a liquid barrier within the chamber 12, upstream and downstream of the spray applicator assembly 14. The liquid 58 or liquids for each header assembly 48 may come from a single, common source or from separate sources. It is understood that, depending upon the particular application, a wide variety of liquids or combinations of liquids may be used. The flat spray nozzles 50 create a liquid barrier that is roughly sheet-like and roughly planar and that is approximately perpendicular to the beam 28. The liquid or water 58 is provided at a pressure that is preferably substantially within a range of from approximately 15 psi to approximately 40 psi and that is more preferably substantially within a range of from approximately 20 psi to approximately 30 psi. The liquid or water 58 is also provided at a flow rate that is preferably substantially within a range of from approximately 0.35 gallons per minute per nozzle to approximately 1.5 gallons per minute per nozzle and that is more preferably substantially within a range of from approximately 0.5 gallons per minute per nozzle to approximately 1.0 gallons per minute per nozzle. If the pressure or flow rate used is too low, the barrier will not provide for adequate containment. If the pressure or flow rate used is too high, the system 10 will make inefficient use of water 58 and power, and the liquid barrier may adversely affect the processing of the meat, poultry, or other workpiece 40, such as by washing or removing an undesirable amount of the substance applied to the meat, poultry, or other workpiece 40.

The water pressure of the upstream header assembly 48 will typically be substantially equal to the water pressure of the downstream header assembly 48. Similarly, the flow rate of the upstream header assembly 48 will typically be substantially equal to the flow rate of the downstream header assembly 48. Still, the independent controls for the upstream and downstream header assemblies 48 allow for different pressures and flow rates to be used. For example, if poultry are sent through the chamber 12 at a high rate, such as approaching 190 birds per minute, turbulence or a vacuum effect created within the chamber 12 may make containment at the downstream barrier more difficult. In this situation, a higher water pressure or flow rate may be used for the downstream header assembly 48. Although the preferred embodiment is described as having upstream and downstream liquid barriers, fewer or more liquid barriers may be employed.

After the liquid barriers are in place, a flow control valve 64 is opened to allow a treating substance 70 to flow through header assemblies 60 and to and through nozzles 62 to create a treatment zone within the chamber 12, inward from the upstream and downstream liquid barriers. The substance or substances 70 for each header assembly 60 may come from a single, common Source or from separate sources. It is understood that the treating substance or substances 70 may take an number of forms or states and may for example be a liquid, a gas, or a powder. It is also understood that, depending upon the workpiece 40 to be treated within the chamber 12, the treating substance or combination of substances 70 may be selected from a very wide variety of items, including but not limited to antimicrobials, disinfectancts, preservatives, spices, flavorings, dyes, sealants, and paints. Each nozzle 62 sprays a roughly cone-shaped stream of a fine, atomized mist or spray. The upper nozzles 62 spray inward and downward, and the lower nozzles 62 spray inward and upward. The substance 70 is provided at a pressure that is preferably substantially within a range of from approximately 25 psi to approximately 50 psi and that is more preferably substantially within a range of from approximately 35 psi to approximately 45 psi, and that is most preferably approximately 40 psi. The substance 70 is also provided at a flow rate that is preferably substantially within a range of from approximately 0.35 gallons per minute per nozzle to approximately 1.5 gallons per minute per nozzle and that is more preferably substantially within a range of from approximately 0.5 gallons per minute per nozzle to approximately 1.0 gallons per minute per nozzle.

The pressure of the upstream legs 66 and 68 will typically be substantially equal to the pressure of the downstream legs 66 and 68. Similarly, the flow rate of the upstream legs 66 and 68 will typically be substantially equal to the flow rate of the downstream legs 66 and 68. Of course, independent controls 64 may be provided to allow for different pressures and flow rates to be used After spraying of the treating substance 70 has begun, the meat, poultry, or other workpieces 40 to be treated are passed along the beam 28, through the opening 38 in upstream end wall 36, through the upstream liquid barrier, through the treatment zone created by the sprayed substance 70, through the downstream liquid barrier, and out the opening 38 in the downstream end wall 36. During treatment, a portion of the substance 70 sprayed within the chamber 12 is applied to the workpiece 40. The upstream and downstream liquid barriers prevent the remaining portion of the substance 70 from escaping the chamber 12. Baffles 34 also prevent the substance 70 from escaping between the header assemblies 48 and the side walls 30. Accordingly, the remaining portion of the substance 70 falls to the drain pans 42 and passes through drain pipes 44, along with water 58 from the upstream and downstream header assemblies 48. The substance 70 and water 58 passing through the drain pipes 44 may be discarded, separated for recovery, or treated in other manners. It is understood that the system 10 may be used to treat a wide variety of different workpieces 40, including but not limited to meat, poultry, fish, fruits, vegetables, and food packaging. It is also understood that the system 10 may be used to treat workpieces 40 completely unrelated to food or food processing items.

Figure 8:
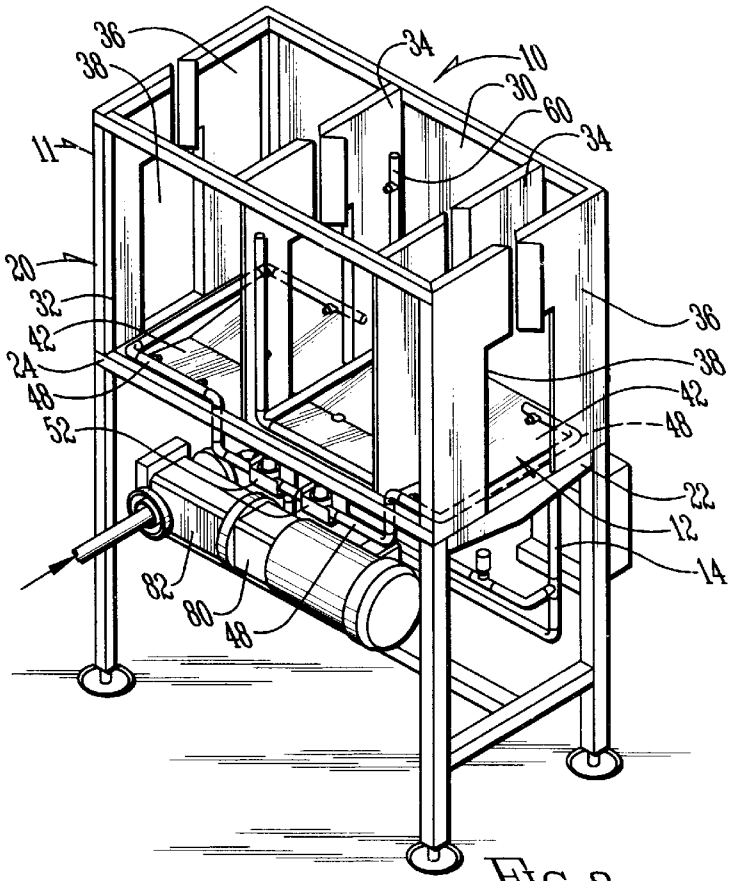
FIG. 8 is a partially exploded, elevation view of the alternate, preferred embodiment of the present invention.
Figure 7:
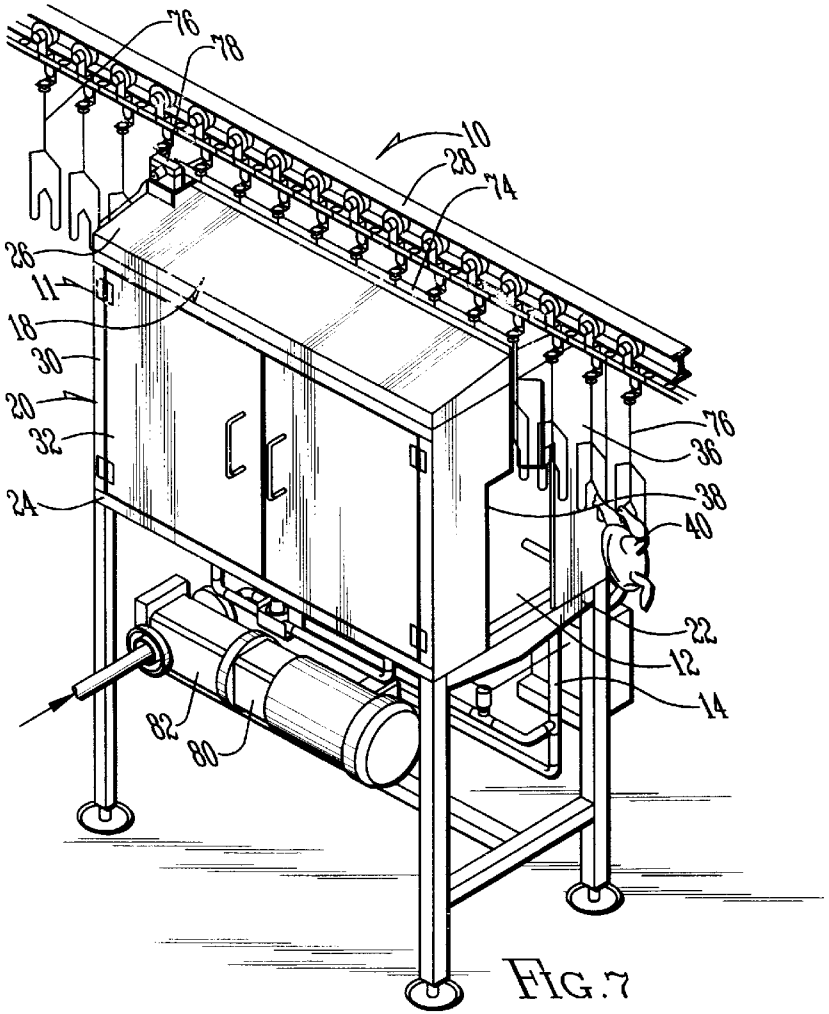
FIG. 7 is an elevation view of an alternate, preferred embodiment of the present invention.

FIGS. 7 and 8 depict an alternate, preferred embodiment of the present invention. The preferred embodiment shares many characteristics and features with the embodiment depicted in FIGS. 1–6, and similar numbers are used to indicate similar parts. As seen in FIG. 7, one important difference is that the roof section 18 has an opening 74 running along its length. The opening is sized to allow hangers 76 suspended from a processing line to pass through the enclosure. In this manner, the enclosure need not be physically affixed to the processing line and may instead be independently supported. A sensor 78 may be provided for tracking the number or rate of hangers passing through the chamber.

Figure 9:
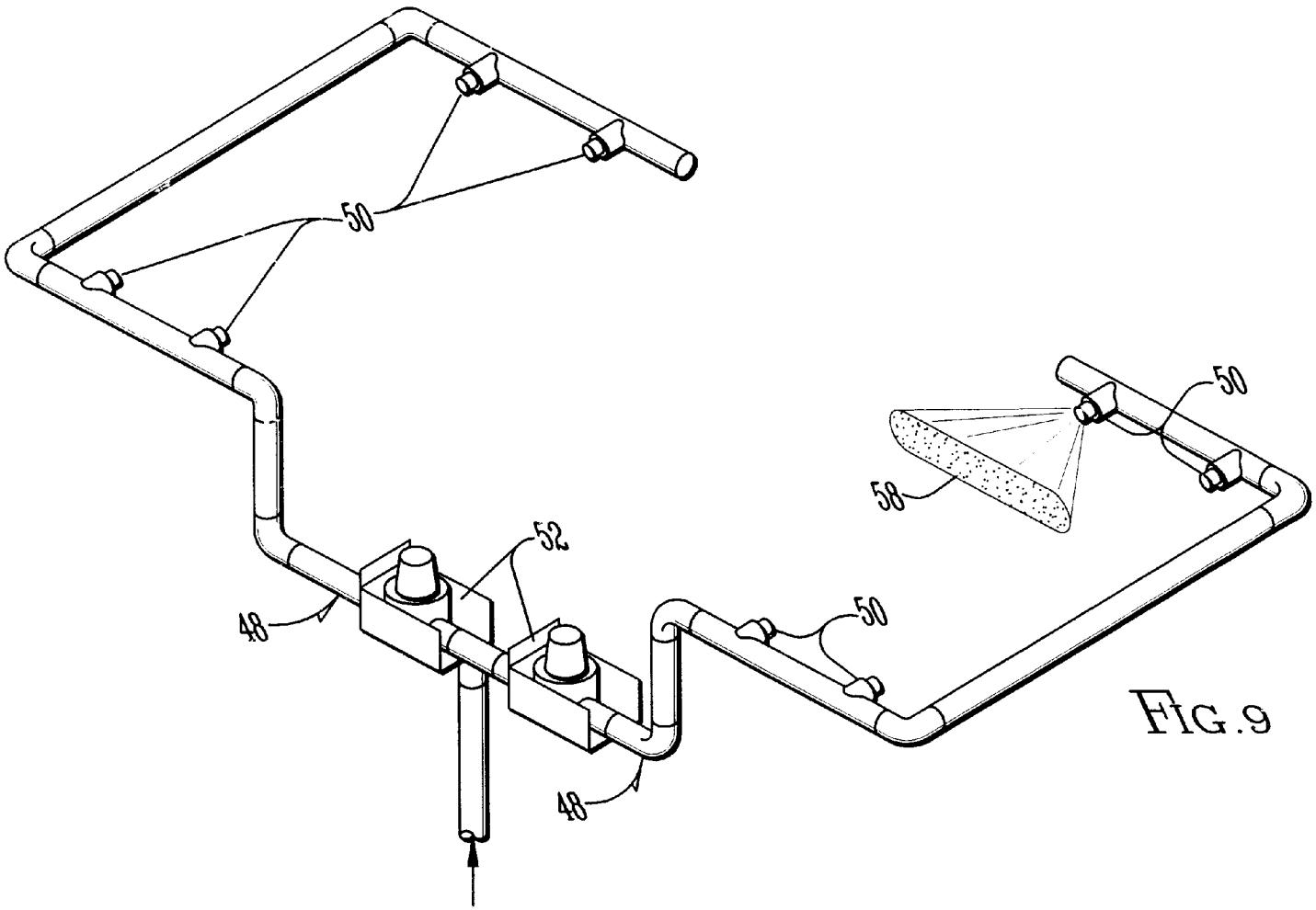
FIG. 9 is an isometric view of a liquid barrier header assembly of a spray application system of the alternate, preferred embodiment of the present invention.

In another important difference, placement and alignment of each liquid barrier generating assembly is altered somewhat. As best seen in FIGS. 8 and 9, the nozzles 50 are disposed in a lower portion of the chamber. Referring to FIG. 9, the nozzles 50 are flat spray nozzles that are aligned or positioned to spray the liquid in a direction angling downward. In the preferred embodiment, two nozzles are positioned on each side of the chamber. As also seen in FIG. 8, one or more pumps 80 and filters 82 may be provided. It is preferred that a pump 80 be employed to provide supplemental pressure, as needed, to the treating substance. A pump 80 will typically not be needed for the water 58, but the use of filters is still preferred to deter clogging of the nozzles 50.

In operation of the embodiment depicted in FIGS. 7–8, flow control valves are opened to allow a liquid, preferably water, to flow through the header assemblies 48, to and through nozzles 50 to create a liquid barrier within the chamber 12, upstream and downstream of the spray applicator assembly 14. The liquid 58 or liquids for each header assembly 48 may come from a single common source or from separate sources. It is understood that, depending upon the particular application, a wide variety of liquids or combinations of liquids may be used. The flat spray nozzles 50 create a liquid barrier that is roughly sheet-like and roughly V-shaped. The liquid or water 58 is provided at a pressure that is preferably substantially within a range of from approximately 15 psi to approximately 40 psi and that is more preferably substantially within a range of from approximately 20 psi to approximately 30 psi. The liquid or water 58 is also provided at a flow rate that is preferably substantially within a range of from approximately 0.35 gallons per minute per nozzle to approximately 1.5 gallons per minute per nozzle and that is more preferably substantially within a range of from approximately 0.5 gallons per minute per nozzle to approximately 1.0 gallons per minute per nozzle. If the pressure or flow rate used is too low, the barrier will not provide for adequate containment. If the pressure or flow rate used is too high, the system 10 will make inefficient use of water 58 and power.

The water pressure of the upstream header assembly 48 will typically be substantially equal to the water pressure of the downstream header assembly 48. Similarly, the flow rate of the upstream header assembly 48 will typically be substantially equal to the flow rate of the downstream header assemble 48. Still, the independent controls for the upstream and downstream header assemblies 48 allow for different pressures and flow rates to be used. Although the preferred embodiment is described as having upstream and downstream liquid barriers, fewer or more liquid barriers may be employed.

After the liquid barriers are in place, a flow control valve 64 is opened to allow a treating substance 70 to flow through header assemblies 60 and to and through nozzles 62 to create a treatment zone within the chamber 12, inward from the upstream and downstream liquid barriers. The substance or substances 70 for each header assembly 60 may come from a single, common source or from separate sources. It is understood that the treating substance or substances 70 may take any number of forms or states and may for example be a liquid, a gas, or a powder. It is also understood that, depending upon the workpiece 40 to be treated within the chamber 12, the treating substance or combination of substances 70 may be selected from a very wide variety of items, including but not limited to antimicrobials, disinfectancts, preservatives, spices, flavorings, dyes, sealants, and paints. Each nozzle 62 sprays a roughly cone-shaped stream of a fine, atomized mist or spray. The upper nozzles 62 spray inward and downward, and the lower nozzles 6' spray inward and upward. The substance 70 is provided at a pressure that is preferably substantially within a range of from approximately 25 psi to approximately 50 psi and that is more preferably substantially within a range of from approximately 35 psi to approximately 45 psi, and that is most preferably approximately 40 psi. The substance 70 is also provided at a flow rate that is preferably substantially within a range of from approximately 0.35 gallons per minute per nozzle to approximately 1.5 gallons per minute per nozzle and that is more preferably substantially within a range of from approximately 0.5 gallons per minute per nozzle to approximately 1.0 gallons per minute per nozzle.

The pressure of the upstream legs 66 and 68 will typically be substantially equal to the pressure of the downstream lets 66 and 68. Similarly, the flow rate of the upstream legs 66 and 68 will typically be substantially equal to the flow rate of the downstream legs 66 and 68. Of course, independent controls 64 may be provided to allow for different pressures and flow rates to be used.

The downward spray of the water by nozzles 50 creates a vacuum upstream and downstream of the treatment zone. As excess sprayed treating substance 70 passes baffles 34 located upstream and downstream of the treatment zone, the vacuum created by nozzles 50 draws the excess sprayed substance 70 downward, where the treating substance 70 contacts the water 58 and is drawn downward with the water to be drained.

After spraying of the treating substance 70 has begun, the meat, poultry, or other workpieces 40 to be treated are passed along the beam 28, through the opening 38 in upstream end wall 36, above the upstream liquid barrier, through the treatment zone created by the sprayed substance 70, above the downstream liquid barrier, and out the opening 38 in the downstream end wall 36. During treatment, a portion of the substance 70 sprayed within the chamber 12 is applied to the workpiece 40. The upstream and downstream liquid barriers prevent the remaining portion of the substance 70 from escaping the chamber 12 without contacting the workpieces. This embodiment therefore provides for containment without creating problems or concerns that the liquid barriers may wash or remove undesirable amounts of the treating substance 70 from the workpieces 40. Baffles 34 also prevent the substance 70 from escaping between the header assemblies 48 and the side walls 30. Accordingly, the remaining portions of the substance 70 are drawn downward into the liquid barriers and fall to the drain pans 42 and pass through drain pipes 44, along with water 58 from the upstream and downstream header assemblies 48. The substance 70 and water 58 passing through the drain pipes 44 may be discarded, separated for recovery, or treated in other manners. It is understood that the system 10 may be used to treat a wide variety of different workpieces 40, including but not limited to meat, poultry, fish, fruits, vegetables, and food packaging. It is also understood that the system 10 may be used to treat workpieces 40 completely unrelated to food or food processing items.

Other modifications, changes and substitutions are intended in the foregoing, and in some instances, some features of the invention will be employed without a corresponding use of other features. For example, a wide variety of different nozzles 50 and 62 may be used for the liquid barrier generator assemblies 16 or for the spray applicator assemblies 14. Also, the nozzles 50 and 62 may be disposed in a wide variety of places and configurations to create a wide variety of barriers and treatment zones having any number of different shapes and sizes. Further, nozzles 50 and 62 need not be used, and the barriers and treatment zones may be formed such as by pouring the liquid or substance. Further still, any number of different alignments of liquid barriers may be used. Of course, quantitative information is included by way of example only and is not intended as a limitation as to the scope of the invention. Accordingly, it is appropriate that the invention be construed broadly and in a manner consistent with the scope of the invention disclosed.

What is claimed is:

1. A combination, comprising:

a chamber;

a processing line passing through said chamber;

a first pipe disposed within said chamber, said first pipe being connected to a source of a first liquid;

a first nozzle operably connected to said first pipe;

a second pipe disposed within said chamber, downstream of said first pipe, said second pipe being connected to a source of a second liquid that is different from said first liquid;

a second nozzle operably connected to said second pipe;

a third pipe disposed within said chamber, downstream of said second pipe, said third pipe being connected to said source of said first liquid;

a third nozzle operably connected to said third pipe; and a plurality of workpieces operably connected to said processing line, said plurality of workpieces being selected from the group consisting of meat, poultry, other foodstuffs, and food packaging.

2. The combination of claim 1, wherein said first liquid is water and said second liquid is an antimicrobial.

3. The combination of claim 1, further comprising:

a first baffle secured to said chamber downstream of said first pipe and upstream of said second pipe; and a second baffle secured to said chamber downstream of said second pipe and upstream of said third pipe.

4. The combination of claim 1, wherein said first and third nozzles comprise flat spray nozzles and said second nozzle comprises a full cone pressure nozzle.

5. The combination of claim 1, further comprising a first control valve operably connected to said first pipe and a second control valve operably connected to said third pipe.

6. The combination of claim 1, wherein said first nozzle is aligned to discharge said first liquid in a downward direction.

7. The combination of claim 6, wherein said first nozzle is aligned to discharge said first liquid so that said first liquid does not contact said plurality of workpieces.

8. The combination of claim 1, further comprising:

a fourth pipe disposed within said chamber, downstream of said second pipe and upstream of said third pipe, said fourth pipe being connected to said source of said second liquid;

a fourth nozzle operably connected to said fourth pipe.

9. A method, comprising:

(a) providing a chamber;

(b) creating a treatment zone within said chamber for applying a substance to a plurality of workpieces, said plurality of workpieces being selected from the group consisting of meat, poultry, other foodstuffs, and food packaging;

(c) creating a first liquid barrier within said chamber downstream of said treatment zone; and (d) passing said plurality of workpieces through said treatment zone and above said first liquid barrier.

10. The method of claim 9, further comprising creating a second liquid barrier upstream of said treatment zone.

11. The method of claim 9, wherein said substance comprises an antimicrobial, and step (b) comprises creating said treatment zone within said chamber for applying said antimicrobial to said plurality of workpieces.

12. The method of claim 11, wherein said first liquid barrier comprises water, said plurality of workpieces comprises a plurality of poultry, and step (d) comprises passing said plurality of poultry through said treatment zone and above or through said water.

13. The method of claim 9, wherein step (c) comprises using water to create said first liquid barrier within said chamber downstream of said treatment zone.

14. The method of claim 9, wherein step (c) comprises spraying water to create said first liquid barrier within said chamber downstream of said treatment zone.

15. The method of claim 14, wherein said water is sprayed at a flow rate that is substantially within a range of from approximately 0.35 gallons per minute per nozzle to approximately 1.5 gallons per minute per nozzle.

16. The method of claim 9, wherein step (b) comprises spraying said substance to create said treatment zone within said chamber for applying said substance to said plurality of workpieces.

17. The method of claim 16, wherein said substance is sprayed at a flow rate that is substantially within a range of from approximately 0.35 gallons per minute per nozzle to approximately 1.5 gallons per minute per nozzle.

18. The method of claim 9, wherein step (c) comprises spraying water at a first rate to create said first liquid barrier within said chamber downstream of said treatment zone; and further comprising, spraying water at a second rate to create a second liquid barrier within said chamber, upstream of said treatment zone, said first rate being different from said second rate.

19. The method of claim 18, wherein said first rate is greater than said second rate.

20. An apparatus, comprising:

a chamber;

means for spraying water to create a first liquid barrier within said chamber;

means for spraying an antimicrobial to create a treatment zone within said chamber, said treatment zone being upstream from said first liquid barrier;

means for spraying water to create a second liquid barrier within said chamber, said second liquid barrier being upstream from said treatment zone; and means for passing a plurality of workpieces through said chamber so that said plurality of workpieces passes above or through said second liquid barrier, then through said treatment zone, then above or through said first liquid barrier, said plurality of workpieces being selected from the group consisting of meat, poultry, other foodstuffs, and food packaging.

21. A method, comprising:

(a) providing a chamber;

(b) creating a treatment zone within said chamber for applying a substance to a plurality of workpieces, said plurality of workpieces being selected from the group consisting of meat, poultry, other foodstuffs, and food packaging;

(c) creating a first liquid barrier within said chamber downstream of said treatment zone;

(d) creating a second liquid barrier within said chamber upstream of said treatment zone; and (e) passing said plurality of workpieces through said treatment zone and above or through said first and second liquid barriers.

22. The method of claim 21, wherein said substance comprises an antimicrobial, and step (b) comprises creating said treatment zone within said chamber for applying said antimicrobial to said plurality of workpieces.

23. The method of claim 21, wherein step (e) comprises passing said plurality of workpieces through said treatment zone and above said first and second liquid barriers.

* * * * *